US011505421B2

(12) United States Patent
Vromen et al.

(10) Patent No.: US 11,505,421 B2
(45) Date of Patent: Nov. 22, 2022

(54) DEFLECTING DEVICE FOR DEFLECTING A CONVEYED SHEET

(71) Applicant: CANON PRODUCTION PRINTING HOLDING B.V., Venlo (NL)

(72) Inventors: Thijs G. M. Vromen, Venlo (NL); Hermanus M. Kuypers, Venlo (NL); Rob Hoogendijk, Venlo (NL); Peter G. La Vos, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 146 days.

(21) Appl. No.: 17/005,969

(22) Filed: Aug. 28, 2020

(65) Prior Publication Data

US 2020/0391970 A1 Dec. 17, 2020

Related U.S. Application Data

(63) Continuation of application No. PCT/EP2019/054632, filed on Feb. 25, 2019.

(30) Foreign Application Priority Data

Feb. 28, 2018 (EP) ..... 18159190

(51) Int. Cl.
*B65H 29/60* (2006.01)
*B41J 3/60* (2006.01)
(Continued)

(52) U.S. Cl.
CPC ..... *B65H 29/60* (2013.01); *B41J 3/60* (2013.01); *B41J 13/0045* (2013.01); *B41J 13/10* (2013.01);
(Continued)

(58) Field of Classification Search
CPC ..... B65H 29/60; B65H 85/00; B65H 2301/3331; B65H 2404/632;
(Continued)

(56) References Cited

U.S. PATENT DOCUMENTS 5,237,381 A * 8/1993 Hamada ..... G03G 15/6576 162/197
5,267,729 A * 12/1993 Hirota ..... B65H 39/11 271/274
(Continued)

FOREIGN PATENT DOCUMENTS

JP 1-197266 * 8/1989
JP 6-1526 * 1/1994
WO WO 2017/222517 A1 12/2017

OTHER PUBLICATIONS

Machine translation of JP1-197266. (Year: 1989).*
(Continued)

*Primary Examiner* — Thomas A Morrison
(74) *Attorney, Agent, or Firm* — Birch, Stewart, Kolasch & Birch, LLP

(57) ABSTRACT

A deflecting device for deflecting a conveyed sheet includes a guiding assembly having an inlet for receiving a conveyed sheet front an upstream section of a main conveying path, a primary outlet for discharging a conveyed sheet onto a downstream section of a main conveying path, a secondary outlet for discharging a conveyed sheet onto an initial section of a side conveying path, and a passing area for passing a conveyed sheet from the inlet towards the primary outlet; and a deflector for deflecting a conveyed sheet towards the secondary outlet, movable into a receiving position for receiving a leading edge of a conveyed sheet inside the passing area and movable into a discharge position for discharging a leading edge of a conveyed sheet towards the secondary outlet, wherein the deflector defines a curved
(Continued)

trajectory for a conveyed sheet deflected towards the secondary outlet in the discharge position, wherein one side of the curved trajectory faces the primary outlet. A functional portion of the deflector is configured to be inserted into the passing area on the one side of the curved trajectory when the deflector moves into the receiving position, and to be retracted from the passing area on the one side of the curved trajectory when the deflector moves out of the discharge position.

20 Claims, 6 Drawing Sheets

(51) Int. Cl.
*B41J 13/00* (2006.01)
*B41J 13/10* (2006.01)
*B65H 85/00* (2006.01)

(52) U.S. Cl.
CPC ..... *B65H 85/00* (2013.01); *B65H 2301/3331* (2013.01); *B65H 2404/632* (2013.01); *B65H 2801/03* (2013.01)

(58) Field of Classification Search
CPC ..... B65H 2801/03; B41J 3/60; B41J 3/0045; B41J 3/10
See application file for complete search history.

(56) References Cited

U.S. PATENT DOCUMENTS

| | | | | |
|---|---|---|---|---|
| 6,460,844 | B1 * | 10/2002 | Clifford | B65H 29/241 271/9.12 |
| 2006/0017209 | A1 * | 1/2006 | Kushida | B65H 31/3081 270/37 |
| 2006/0203271 | A1 * | 9/2006 | Su | B41J 11/006 358/1.12 |
| 2010/0252980 | A1 * | 10/2010 | Kushida | B65H 29/58 271/226 |
| 2011/0062661 | A1 | 3/2011 | Shimonaga | |
| 2016/0145063 | A1 | 5/2016 | Segers et al. | |

OTHER PUBLICATIONS

International Search Report (PCT/ISA/210) issued in PCT/EP2019/0054632, dated May 24, 2019.
Search Report issued in European Patent Application No. 18 15 9190, dated Aug. 20, 2018.
Written Opinion (PCT/ISA/237) issued in PCT/EP2019/0054632, dated May 24, 2019.

* cited by examiner

DEFLECTING DEVICE FOR DEFLECTING A CONVEYED SHEET

CROSS REFERENCE TO RELATED APPLICATIONS

This application is a Continuation of PCT International Application No. PCT/EP2019/054632, filed on Feb. 25, 2019, which claims priority under 35 U.S.C. 119(a) to Patent Application No. 18159190.0, filed in Europe on Feb. 28, 2018, all of which are hereby expressly incorporated by reference into the present application.

FIELD OF THE INVENTION

The present invention relates to a deflecting device for deflecting a conveyed sheet, comprising a guiding assembly having an inlet for receiving a conveyed sheet from an upstream section of a main conveying path, a primary outlet for discharging a conveyed sheet onto a downstream section of a main conveying path, a secondary outlet for discharging a conveyed sheet onto an initial section of a side conveying path, and a passing area for passing a conveyed sheet from the inlet towards the primary outlet; and a deflector for deflecting a conveyed sheet towards the secondary outlet, movable into a receiving position for receiving a leading edge of a conveyed sheet inside the passing area and movable into a discharge position for discharging a leading edge of a conveyed sheet towards the secondary outlet, wherein the deflector defines a curved trajectory for a conveyed sheet deflected towards the secondary outlet in the discharge position, wherein one side of the curved trajectory faces the primary outlet. The present invention further relates to a sheet handing system comprising a deflecting device for deflecting a conveyed sheet, to a printing system comprising a sheet handling system, and to a method for deflecting a conveyed sheet.

BACKGROUND ART

A paper handling system of a printer or a copier may comprise a deflecting device for deflecting a conveyed sheet of paper from a main conveying path to a side conveying path. The main conveying path may comprise a printing path, arranged for conveying a stream of sheets in a specific orientation past a print engine, so that a printed image can be received on a front side of each individual sheet of paper. The side conveying path may comprise a returning path, arranged for returning sheets of paper from an end of the printing path back to a start of the printing path. After being returned to the start of a printing path, a sheet of paper can be conveyed past a print engine for a second time, so that a printed image can also be received on a back side of the sheet of paper. A device for changing the orientation of a sheet of paper may be provided on the returning path, to enable a sheet of paper to be discharged back onto the printing path in a reverse orientation.

US 2016/0145063 A1 describes a deflating device according to the introductory paragraph, comprising a deflector configured to be flipped between different positions so that a conveyed sheet passing from the inlet towards the primary outlet and a conveyed sheet deflected towards the secondary outlet pass on opposite sides of the deflector. A side of the deflector facing the primary outlet in the receiving position is provided with a recess for accommodating a trailing edge of a sheet passing towards the primary outlet. The recess allows for a distance between a leading sheet passing towards the primary outlet and a following sheet deflected towards the secondary outlet to be relatively short. A short distance between a leading sheet and a following sheet improves the efficiency of a sheet handing system and increases the productivity of a printing or copying system.

SUMMARY OF THE INVENTION

An object of the present invention is to provide a further improved deflecting device. In particular, an object of the invention is to provide a deflecting device that allows both a distance between a leading sheet passing towards the primary outlet and a following sheet deflected towards the secondary outlet and a distance between a leading sheet deflected towards the secondary outlet and a following sheet passing towards the primary outlet to be relatively short.

According to a main aspect of the invention, a functional portion of the deflector is configured to be inserted into the passing area on the one side of the curved trajectory when the deflector moves into the receiving position, and to be retracted from the passing area on the one side of the curved trajectory when the deflector moves out of the discharge position.

In a device according to the main aspect of the invention, the functional portion can be retracted from the passing area already before a conveyed sheet deflected towards the secondary outlet has completely passed the deflector. As a result, the passing area can be free to receive a sheet following a deflected sheet immediately after a trailing edge of the deflected sheet has left the passing area. A conveyed sheet following a deflected sheet is thereby allowed to follow the deflected sheet at a minimal distance, while still being able to pass towards the primary outlet through the passing area. The minimal distance provides a relatively high efficiency of a sheet handling system comprising the deflecting device, and a relatively high productivity of a printing or copying system comprising such a sheet handling system.

The functional portion may be configured to be inserted into the passing area from a side of the passing area opposite a side of the passing area facing the secondary outlet. This allows for a relatively simple design of the deflector and for a relatively simple way of positioning the deflector inside the passing area for receiving a leading edge of a conveyed sheet.

The discharge position may be different from the receiving position, so that only little time may be needed for bringing the deflector in the receiving position by inserting the functional portion into the passing area, while a leading edge of a conveyed sheet may still reliably be discharged towards a secondary outlet positioned at a certain distance from the passing area by bringing the functional portion closer to the secondary outlet after receiving the leading edge of the conveyed sheet.

In order to allow for a relatively high speed of conveyance of a sheet while limiting the impact of the sheet onto the deflector, the deflector may be configured to move through the receiving position at a certain speed before moving into the discharge position. A leading edge of a conveyed sheet deflected towards the secondary outlet may in that case be received onto a moving deflector, and move together with the deflector towards a position close to the secondary outlet before being discharged.

Preferably, the functional portion is configured to move at least as fast as a conveyed sheet when the deflector moves from the receiving position into the discharge position, to provide smooth operation of the deflecting device.

A deflector surface for receiving a leading edge of a conveyed sheet may have an inclined orientation with respect to the upstream section of the main conveying path in the receiving position of the deflector, so that a leading edge of a conveyed sheet can be relatively smoothly received onto the deflector from the main conveying path.

A deflector surface for discharging a leading edge of a conveyed sheet may extend in line with the initial section of the side conveying path in the discharge position of the deflector, so that a leading edge of a conveyed sheet can be relatively smoothly discharged from the deflector onto the side conveying path.

A speed of motion of the functional port on may have a component extending in parallel to a deflector surface for receiving a leading edge of a conveyed sheet when the deflector moves through the receiving position, to further promote a leading edge of a conveyed sheet to be smoothly received onto the deflector.

A speed of motion of the functional port on may have a component extending in parallel to a deflector surface for discharging a leading edge of a conveyed sheet when the deflector moves into the discharge position, to further promote a leading edge of a conveyed sheet to be smoothly discharged onto the side conveying path.

A path of motion of the functional portion may be straight or curved, in order for a deflector surface to have a desired position with respect to the upstream section of the main conveying path for receiving a leading edge of a conveyed sheet in the receiving position of the deflector and/or a desired position with respect to the initial section of the side conveying path for discharging a leading edge of a conveyed sheet in the discharge position of the deflector.

The functional portion may have a relatively thin tip section, so that only a relatively short distance is required for receiving the functional portion in between the trailing edge of a leading sheet passing towards the primary outlet and the leading edge of a following sheet deflected towards the secondary outlet.

The functional portion may have an elongated shape, for easy further insertion of the functional portion in between the trailing edge of a leading sheet and the leading edge of a following sheet, as well as to enable the deflector to be relatively light-weight.

A functional portion of elongated shape may be configured to be inserted into the passing area at an acute angle with respect to the main conveying path or at least the upstream section thereof, so that the functional portion may be inserted and moved further into an interior space of the guiding assembly for receiving and discharging the leading edge of a sheet to be deflected with little interference of the deflector with the trailing edge of a leading sheet passing towards the primary outlet.

BRIEF DESCRIPTION OF DRAWINGS

The invention will be described in more detail with reference to the drawings, wherein.

DETAILED DESCRIPTION OF EMBODIMENTS

Figure 1:
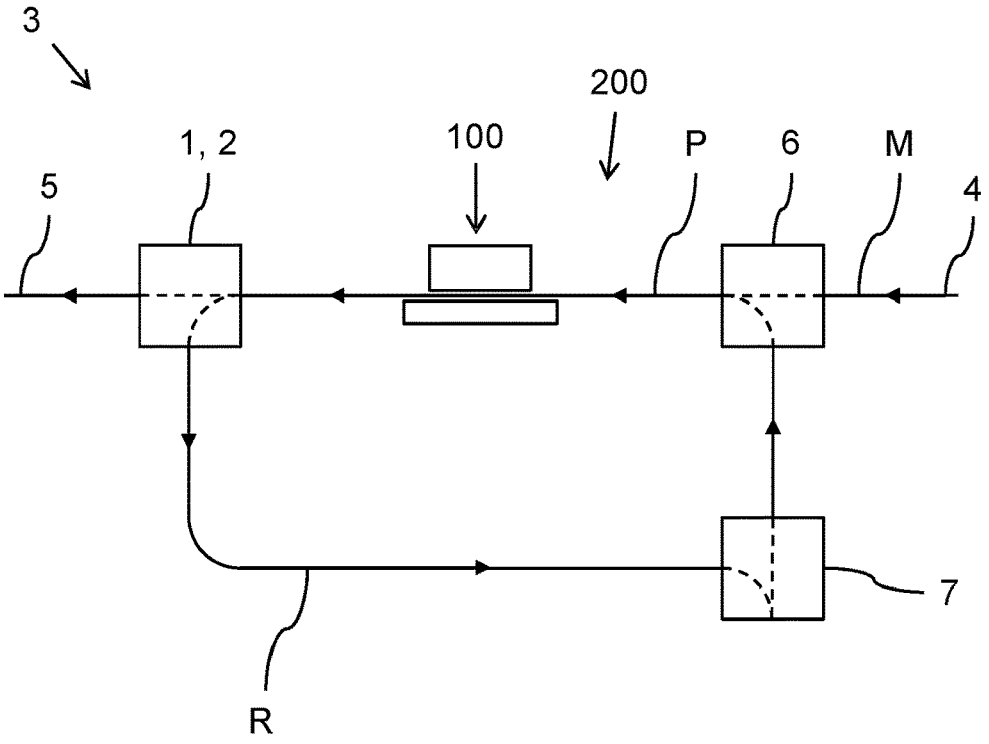
FIG. 1 shows, in a schematic representation, a printing system composing a print engine and a sheet handling system.

With reference to FIG. 1, a printing system 3 for printing on a cut-sheet image recording medium such as sheet paper of a certain size comprises a print engine 100 for printing an image on a single side of an individual sheet of the image recording medium and a sheet handling system 200.

The sheet handling system 200 has a printing path P for conveying a stream of individual sheets of the image recording medium in a specific orientation past the print engine 100, and a returning path R for returning certain sheets of the image recording medium from an end of the printing path P after the print engine 100 back to a start of the printing path P before the print engine 100.

The printing path P is part of a main conveying path M for conveying a stream of individual sheets through the sheet handling system 200 from a system inlet 4 to a system outlet 5.

A deflecting device 1, 2 for deflecting certain sheets from the main conveying path M to the returning path R is situated on the main conveying path M at the end of the printing path P.

An introducing device 6 for introducing sheets from the returning path R back onto the main conveying path M is situated on the main conveying path M at the start of the printing path P.

A flipping device 7 for changing the orientation of a sheet conveyed along the returning path R is arranged on the returning path R between the deflecting device 1, 2 and the introducing device 6.

In operation of the printing system 3, an unprinted sheet is received onto the main conveying path M via the system inlet 4, and then conveyed to pass undisturbed through the introducing unit 6 towards the printing path P.

On the printing path P, the unprinted sheet may receive a printed image on a side of the sheet that is presented to the print engine 100 for receiving such an image.

In case only a front side of a sheet needs to be printed, a sheet coming from the printing path P which has only one time passed the print engine 100 may be conveyed further along the main conveying path M. and may pass undisturbed through the deflecting device 1, 2 towards the system outlet 5.

In case a back side of a sheet needs to be printed, a sheet coming from the printing path P which has only one time passed the print engine 100, and which may already have a printed front side, is conveyed to be deflected by the deflecting device 1, 2 from the main conveying path M towards the returning path R.

A sheet conveyed along the returning path R is flipped by the flipping device 7, and the sheet is then introduced back onto the main conveying path M and the printing path P in a reverse orientation by the introducing unit 6.

A sheet coming from the printing path P which has passed the print engine 100 for a second time may still be conveyed to pass undisturbed through the deflecting device 1, 2 towards the system outlet 5.

Figure 2:
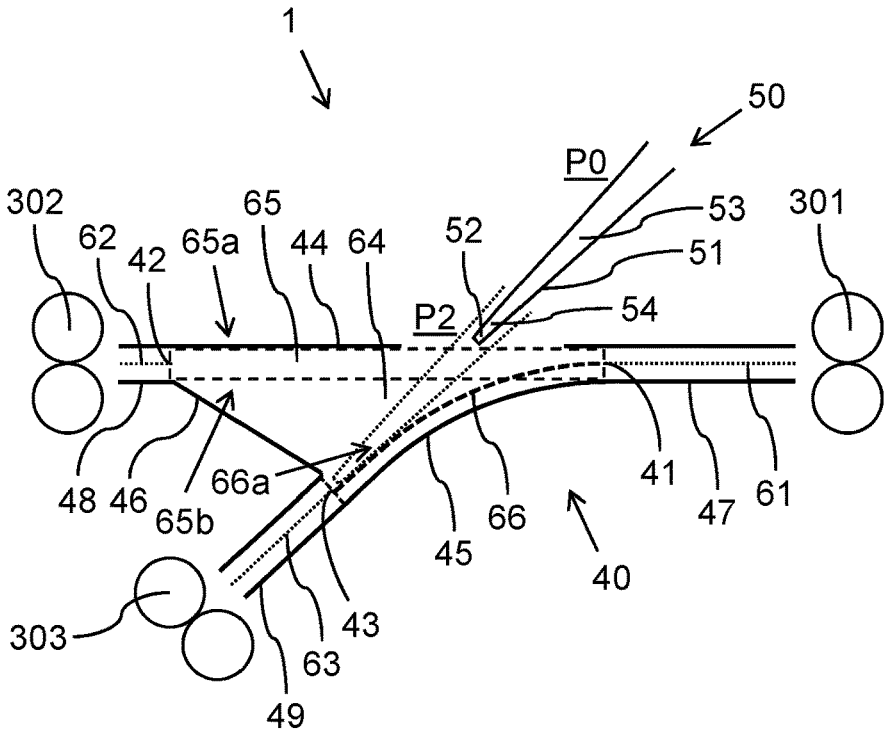
FIG. 2 shows, in a schematic cross-sectional representation, a first embodiment of a deflecting device according to the invention, comprising a guiding assembly and a movable deflector.

With reference to FIG. 2, in a first embodiment of the invention, a deflecting device 1 comprises a guiding assembly 40 having a set of guides 44, 45, 46 enclosing an interior space 64.

The interior space 64 has an inlet 41 for receiving a leading portion of a conveyed sheet from an incoming conveying path 61. With reference to FIG. 1, the incoming conveying path 61 forms, or at least connects to an upstream section of the main conveying path M comprising an end section of the printing path P.

The interior space 64 further has a primary outlet 42 for discharging a leading portion of a conveyed sheet onto a primary outgoing conveying path 62, and a secondary outlet 43 for discharging a leading portion of a conveyed sheet onto a secondary outgoing conveying path 63. With reference to FIG. 1, the primary outgoing conveying path 62 forms, or at least connects to a downstream section of the main conveying path M extending towards the system outlet 5, and the secondary outgoing conveying path section 63 forms, or at least connects to an initial section of the returning path R.

The primary outlet 42 is positioned relative to the inlet 41 such that a leading portion of a conveyed sheet received inside the interior space 64 via the inlet 41 will be able to pass towards the primary outlet 42 merely as a result of a connected trailing portion of the conveyed sheet being propelled along the incoming conveying path 61, for instance by a pair of pinching rollers 301 positioned along the main conveying path M upstream of the inlet 41.

In the shown example, the primary outgoing conveying path 62, or at least a portion thereof defined by a primary outgoing guiding channel 48 starting at the primary outlet 42, extends in line with the incoming conveying path 61, or with at least a portion thereof defined by an incoming guiding channel 47 ending at the inlet 41. This enables a leading portion of a conveyed sheet received via the inlet 41 to be directed towards the primary outlet 42 merely as a result of its stiffness, wherein the leading portion passes through a passing area 65 defined within the interior space 64 providing a direct route for a leading portion of a conveyed sheet from the inlet 41 to the primary outlet 42.

The secondary outlet 43 is arranged on one side 65*b* of the passing area 65, at a certain distance away from the passing area 65, and positioned in between the inlet 41 and the primary outlet 42 when seen in the direction of conveyance of a sheet passing through the passing area 65.

The secondary outgoing conveying path 63, or at least a portion thereof defined by a secondary outgoing guiding channel 49 starting at the secondary outlet 43, is positioned at an acute angle to the primary outgoing conveying path 62, or at least a portion thereof defined by the primary outgoing guiding channel 48.

A pair of pinching rollers 302 is positioned along the main conveying path M downstream of the primary outlet 42, as an example of a device for propelling a conveyed sheet along the primary outgoing conveying path 62 once at least a leading portion of a conveyed sheet has been discharged onto the primary outgoing conveying path 62 via the primary outlet 42.

A further pair of pinching rollers 303 is positioned along the returning path R downstream of the secondary outlet 43, as an example of a device for propelling a conveyed sheet along the secondary outgoing conveying path 63 once at least a leading portion of a conveyed sheet has been discharged onto the secondary outgoing conveying path 63 via the secondary outlet 43.

A guide 44 extending between the inlet 41 and the primary outlet 42 on a side 65*a* of the passing area 65 opposite a side 65*b* facing the secondary outlet 43 extends in parallel to the passing area 65 or at least in parallel to a direction of conveyance of a sheet passing through the passing area 65, to prevent a leading edge of a conveyed sheet passing through the passing area 65 from escaping the passing area 65 on said opposite side 65*a*.

A guide 45 extending between the inlet 41 and the secondary outlet 43 has a curved shape, such that the guide 45 extends in parallel to the incoming conveying path 61 at the inlet 41, and the guide 45 extends in parallel to the secondary outgoing conveying path 63 at the secondary outlet 43.

A guide 46 extending between the primary outlet 42 and the secondary outlet 43 has an orientation for guiding a leading edge of a conveyed sheet towards the primary outlet 42 in case a leading edge of a conveyed sheet passes through the interior space 64 outside the passing area 65 and the leading edge is received by said guide 46.

Figure 3A:
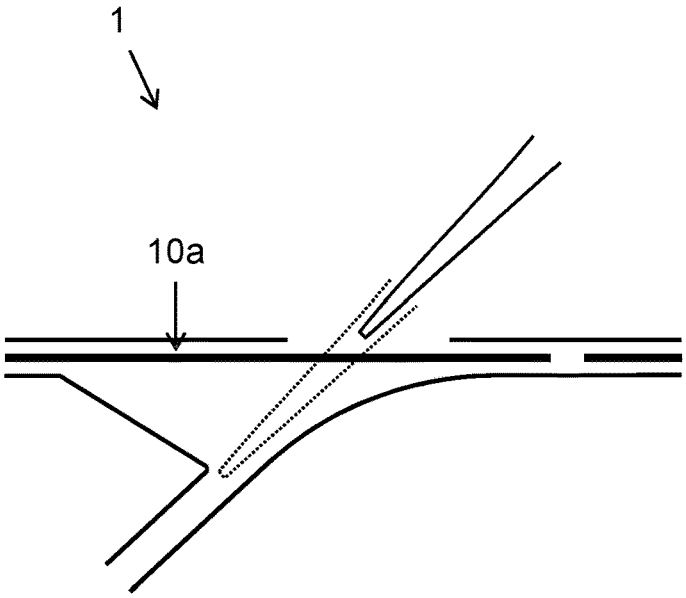
FIGS. 3*a*-3*h* and FIG. 4 show the deflecting device of FIG. 2 in various stages of operation with the deflector in various positions with respect to the guiding assembly.
Figure 3B:
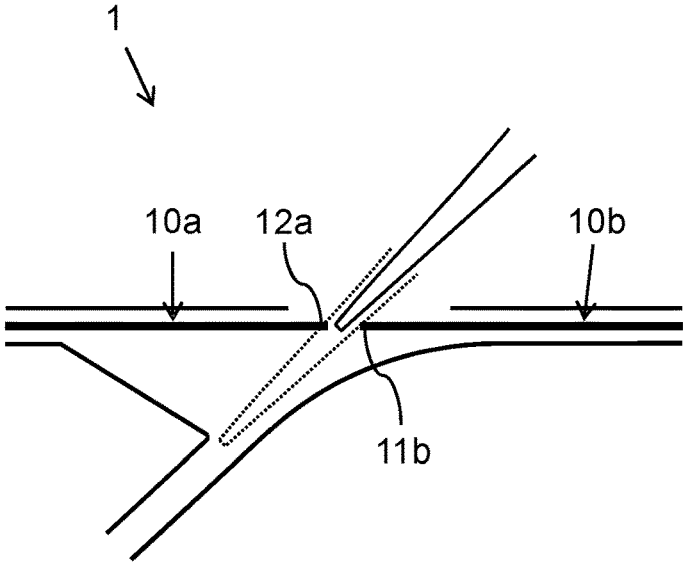
Figure 3C:
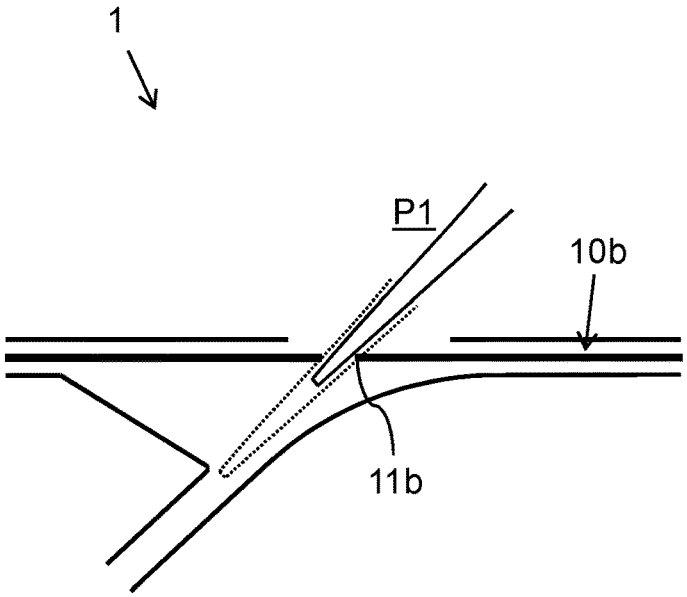

The deflecting device 1 further comprises a deflector 50 for deflecting a conveyed sheet towards the secondary outlet 43, movable into a receiving position P1 as shown in FIG. 3*c* for receiving a leading edge of a conveyed sheet inside the passing area 65, and further movable into a discharge position P2 as shown in FIG. 2 for discharging a leading edge of a conveyed sheet towards the secondary outlet 43.

The deflector 50 comprises a functional portion 53 having a deflecting surface 51 arranged for receiving a leading edge of a conveyed sheet inside the passing area 65 in the receiving position P1 and arranged for discharging a leading edge of a conveyed sheet towards the secondary outlet 43 in the discharge position P2.

The functional portion 53 has a discharge end 52 at which a leading edge of a conveyed sheet can be discharged from the deflecting surface 53.

The deflector 50 is movable into the receiving position P1 from an inoperative position P0 as shown in FIG. 2 in which the functional portion 53, and especially a tip section 54 thereof comprising a portion of the deflecting surface 51 and the discharge end 52, is situated outside the passing area 65 at the side 65*a* of the passing area 65 opposite the side 65*b* facing the secondary outlet 43.

The functional portion 53, and especially a tip section 54 thereof composing a portion of the deflecting surface 51 and the discharge end 52, is configured to be inserted into the passing area 65 from said side 65*a* of the passing area 65 opposite the side 65*b* facing the secondary outlet 43 when the deflector 50 moves from the inoperative position P0 into the receiving position P1.

In the shown example, the functional portion 53 has an elongated shape. The functional portion 53 is configured to be inserted into the passing area 65 at an acute angle with respect to the incoming conveying path 61, so that in the receiving position P1 of the deflector 50, the deflecting surface 51 has an inclined orientation with respect to said incoming conveying path 61.

From the receiving position P1, the deflector 50 is movable into the discharge position P2, which in the shown embodiment differs from the receiving position P1 in the sense that the discharge end 52 is located closer to the secondary outlet 43 in the discharge position P2 than in the receiving P1.

In the embodiment of FIG. 2, the functional portion 53 is configured to perform a purely translational motion along a straight line in moving from the inoperative position P0 into the discharge position P2 via the receiving position P1.

In the discharge position P2 of the deflector 50, the deflecting surface 51 extends in line with the secondary outgoing conveying path 63.

As a result of an inclined orientation of the deflecting surface 51 with respect to the incoming conveying path 61 in the discharge position P2 and as a consequence of the deflecting surface 51 also acting as a guiding surface 51 for a conveyed sheet deflected towards the secondary outlet 43 once at least a leading portion of such a conveyed sheet has been discharged onto the secondary outgoing conveying path 63, the deflector 50 defines a curved trajectory 66 for a conveyed sheet deflected towards the secondary outlet 43 in the discharge position P2.

With the deflector 50 in the discharge position P2, the curved trajectory 66 provides a direct route for a trailing portion of a conveyed sheet from the inlet 41 to the secondary outlet 42 once a leading portion of the conveyed sheet has been discharged onto the secondary outgoing conveying path 63, through an area of the interior space 64 which is delimited on one side by the deflector 50 and on the other side by the curved guide 45 extending between the inlet 41 and the secondary outlet 43.

It is noted that by the deflector 50 being movable from the inoperative position P0 to the receiving position P1 as described, the functional portion 53, and especially a tip section 54 thereof comprising a portion of the deflecting surface 51 and the discharge end 52, is configured to be inserted into the passing area 65 on a side 66*a* of the curved trajectory 66 facing the primary outlet 42 when the deflector 50 moves into the receiving position P1.

From the discharge position P2, the defector 50 is movable back into the inoperative position P0, wherein the functional portion 53, and especially a tip section 54 thereof comprising a portion of the deflecting surface 51 and the discharge end 52, is configured to be retracted from the passing area 65 at the side 65*a* of the passing area 65 opposite the side 65*b* facing the secondary outlet 43.

It is noted that by the deflector 50 being movable from the discharge position P2 to the inoperative position P0 as described, the functional portion 53, and especially a tip section 54 thereof composing a portion of the deflecting surface 51 and the discharge end 52, is configured to be extracted from the passing area 65 on the side 66*a* of the curved trajectory 66 facing the primary outlet 42 when the deflector 50 moves out of the discharge position P2.

With reference to FIG. 2 and FIG. 3*a*, in the inoperative position P0 of the deflector 50, the functional portion 53 is situated outside the passing area 65 to allow a conveyed sheet 10*a* to pass undisturbed from the inlet 41 towards the primary outlet 42.

Figure 3D:
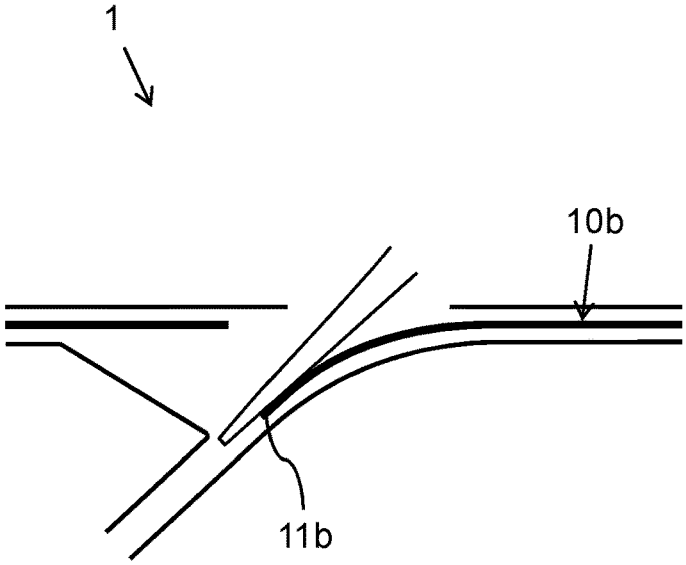
Figure 3E:
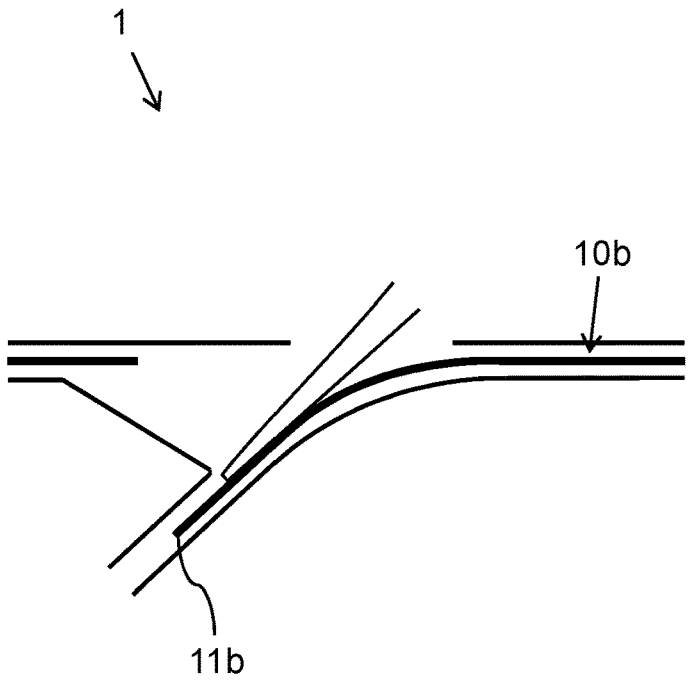

With reference to FIG. 2 and FIG. 3*d*, when a sheet 10*b* following a leading sheet 10*a* passing towards the primary outlet 42 is to be deflected towards the secondary outlet 43, the deflector 50 moves into the receiving position P1, wherein the tip section 54 of the functional portion 53 is inserted into the passing area 65 in between the trailing edge 12*a* of the leading sheet 10*a* and the leading edge 11*b* of the following sheet 10*b*.

With reference to FIG. 2 and FIG. 3*c*, while the deflector 50 moves through the receiving position P1 at a certain speed, the leading edge 11*b* of the sheet 10*b* to be deflected is received by a portion of the deflecting surface 51 provided on the tip section 54 of the functional portion 53.

With reference to FIG. 2 and FIG. 3*d*, from the receiving position P1, the deflector 50 moves into the discharge position P2, wherein the received leading edge 11*b* of the sheet 10*b* to be deflected moves together with the functional portion 53 to a position closer to the secondary outlet 43.

With reference to FIG. 2 and FIG. 39, when the deflector 50 reaches the discharge position P2, the received leading edge 11*b* of the sheet 10*b* to be deflected is discharged from the deflecting surface 51 at the discharge end 52 of the functional portion 53, as a result of the functional portion 53 coming to a halt while the deflected sheet 10*b* is being conveyed further, wherein the functional portion 53 acts as a guide guiding the sheet 10*b* towards the secondary outlet 43.

Figure 3F:
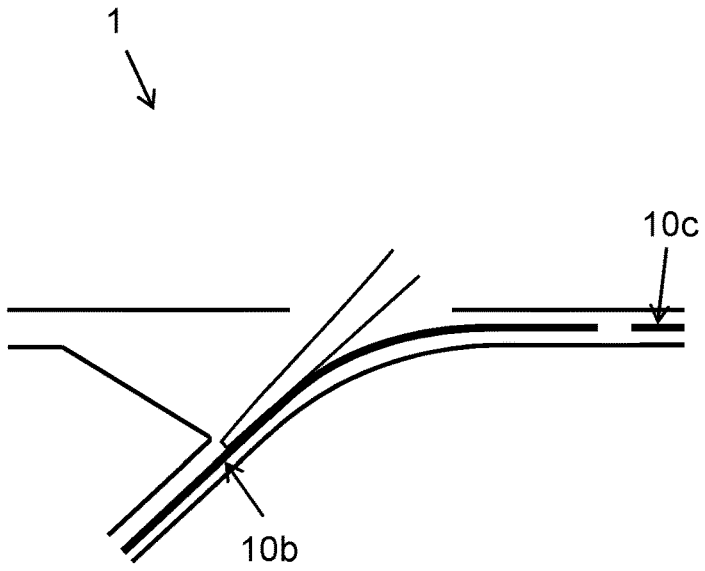

With reference to FIG. 2 and FIG. 3*f*, the deflector 50 may be held in the discharge position P2 until a sheet 10*c* following the deflected sheet 10*b*, which next sheet 10*c* is not to be deflected, approaches the passing area 65.

Figure 3G:
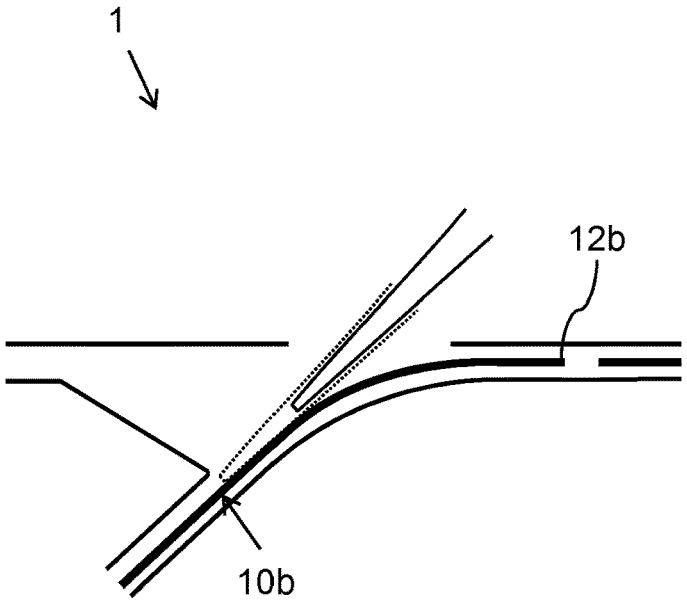

With reference to FIG. 2 and FIG. 3*g*, according to an advantageous aspect of the invention, the deflector 50 can be moved back from the discharge position P2 towards the inoperative position P0 already before a portion of the deflected sheet 10*b* comprising the trailing edge 12*b* has bean discharged from the interior space 64 via the secondary outlet 43.

Figure 3H:
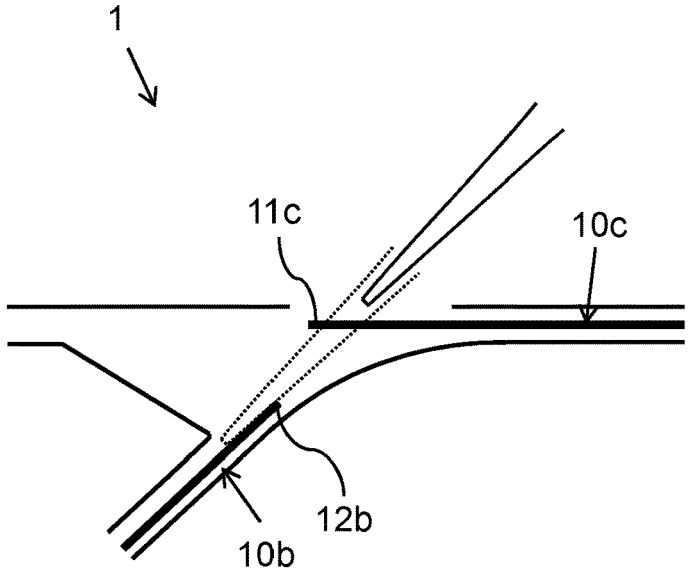

With reference to FIG. 2 and FIG. 3*h*, once the trailing edge 12*b* of a deflected sheet 10*b* has left the passing area 65, the passing area 65 is free to receive the leading edge 11*c* of a sheet 10*c* following a deflected sheet 10*b* once the tip section 54 comprising a portion of the deflecting surface 51 and the discharge end 52 is again situated outside the passing area 65, incase such a sheet 10*c* following a deflected sheet 10*b* is to be passed undeflected towards the primary outlet 42.

In summary, a method for deflecting a conveyed sheet 10*b* from a main conveying path M towards a side conveying path R performed by the deflecting device 1 of FIG. 2 comprises the steps of

- ahead of the sheet 10*b*, bringing a deflector 50 into the main conveying path M in a first position P1 in which a surface 51 provided on the deflector 50 is arranged for receiving a leading edge 11*b* of the sheet 10*b* and guiding the leading edge 11*b* towards a discharge end 52 of the deflector 50 in a direction deviating from the direction of conveyance along the main conveying path M;
- after receiving the leading edge 11*b*, moving the deflector 50 towards a position P2 in which the discharge end 52 is positioned closer to an initial section 63 of the side conveying path R than in the first position P1.
- discharging the leading edge 11*b* onto the initial section 63 of the side conveying path R, and
- retracting the deflector 50 from the second position P2 and the main conveying path M.

In order for the functional portion 53 to have a certain speed when the deflector 50 moves through the receiving position P1, the deflector 50 may be accelerated already outside the main conveying path M. The speed of the functional portion 53, or at least the speed of the tip portion 54 in the direction of motion of the tip portion 54 preferably equals at least the speed of conveyance of a sheet 10*b* received and deflected by said functional portion 53, so that the deflector 50 can reach the desired discharge position P2 with the discharge end 52 positioned ahead of the leading edge 11*b* of the sheet 10*b* before the leading edge 11*b* is discharged towards the secondary outlet 53.

The velocity of the functional portion 53 preferably has a component extending in parallel to the deflecting surface 51 at the location for receiving a leading edge 11*b* of a sheet 10*b* to be deflected when the deflector 50 moves through the receiving position P1, and preferably has a component extending in parallel to the deflecting surface 51 at the location for discharging a leading edge 11 of a sheet 10*b* to be deflected when the deflector 50 moves into the discharge position.

The functional portion 53, or at least a portion for receiving a leading edge 11*b* of a sheet 10*b* to be deflected preferably also has a velocity component extending in the direction of conveyance along the main conveying path M when the deflector 50 moves through the receiving position, to limit the effects of the leading edge 11*b* colliding with the deflector 50.

An actuation mechanism for moving the deflector 50 between the different positions can be triggered by a sensor for sensing the leading edge 11*b* of a sheet 10*b* to deflected passing a sensing location upstream of the inlet 41, or may controlled according to a timing schedule according to which individual sheets 10*a*, 10*b*, 10*c* are made to be conveyed along the main conveying path M.

It is noted that a device as described may still be useful for deflecting a conveyed sheet 10*b* when the leading edge 11*b* of the sheet 10*b* lies close to the trailing edge 12*a* of a leading sheet 10*a* passing towards the primary outlet 42 without a substantial interstitial space, or when a leading portion of a sheet 10*b* to be deflected even overlaps with a trailing portion of a sheet 10*a* passing towards the primary outlet 42, possibly as a result of one of the sheets 10*a*. 10*b* having a skewed position with respect to the other one.

Figure 4:
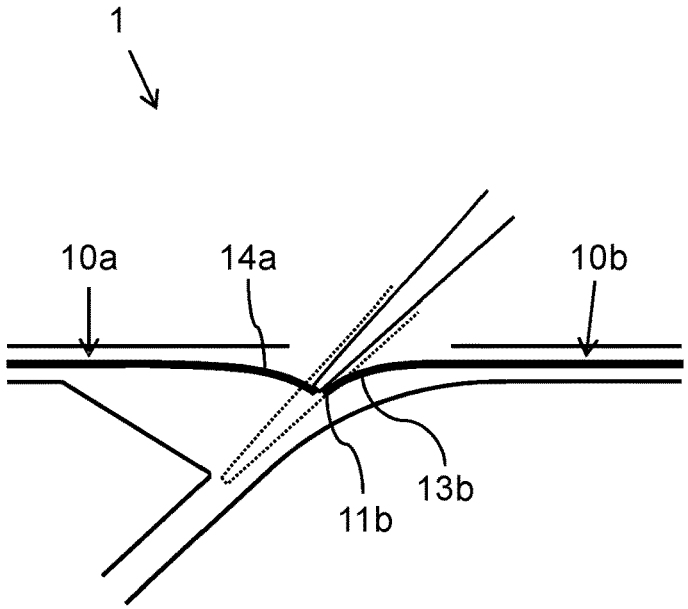

With reference to FIG. 2 and FIG. 4, in such a case, the leading edge 11*b* of a sheet 10*b* to be deflected may be received onto the functional portion 53 inside the interior space 64 outside the passing area 65 after the functional portion 53 has been inserted sufficiently far into the interior space 64, such that the discharge end 52 of the deflector 50 passes the leading edge 11*b* of the sheet 10*b* while moving towards the discharge position P2 after a portion 13*b* of the sheet 10*b* connected to the leading edge 11*b* has already been received onto the deflecting surface 51.

Especially in such a case, or in the case that the leading edge 11*b* is located ahead of the location of insertion of the functional portion 53 into the passing area 65 at the time of the insertion, it is important for the discharge end 52 to move faster than the deflected sheet 10*b* In order for the discharge end 52 to reach a position close to the secondary outlet 53 before the leading edge 11*b* is discharged from the deflecting surface 51, and to prevent a leading portion 13*b* of the deflected sheet 10*b* from reaching the guide 46 extending between the primary outlet 42 and the secondary outlet 43.

In the shown example, the guide 45 extending between the inlet 41 and the secondary outlet 43 and the guide 46 extending between the primary outlet 42 and the secondary outlet 43 each deviate away from the passing area 65 when seen in the direction towards the secondary outlet 43, so that a trailing portion 14*a* of a sheet 10*a* passing towards the primary outlet 41 and a leading portion 13*b* of a sheet 10*b* deflected towards the secondary outlet 43 are each allowed to move together with the functional portion 53 while the deflector 50 moves towards the discharge position P2, in order to prevent either of those portions 13*b*, 14*a* from getting stuck between the functional portion 53 and one of those guides 45, 46.

Figure 5:
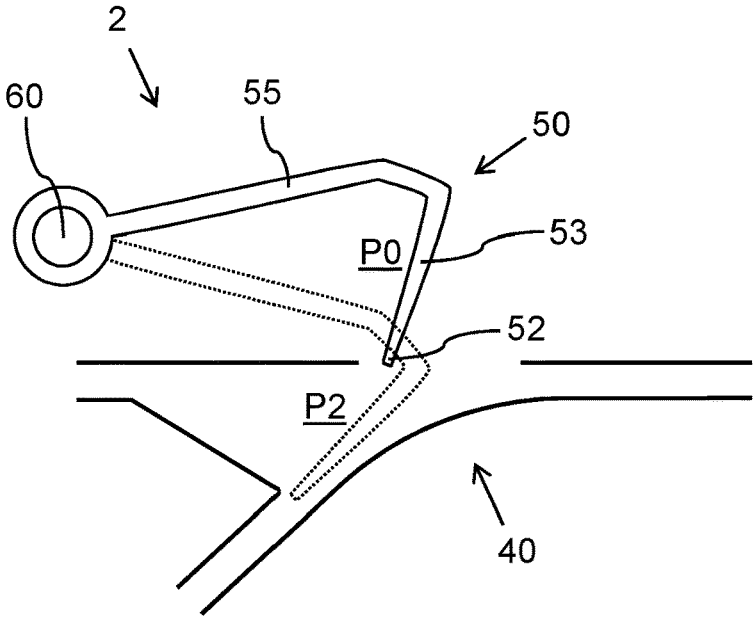
FIG. 5 shows, in a schematic cross-sectional representation, a second embodiment of a deflecting device according to the invention.

With reference to FIG. 5, in a practical embodiment, a deflecting device 2 according to the invention may comprise an actuation mechanism 60 for rotating the deflector 50 in order to move the deflector 50 between the inoperative position P0, the receiving position P1 and the discharge position P2 The functional portion 53 may then be connected to an arm 55 rotated by the actuation mechanism 60, such that the functional portion 53 assumes different positions with respect to the guiding assembly 40 depending on the degree of rotation of the arm 55. It is noted that in such an embodiment, an angle of inclination of the functional portion 53 with respect to the main conveying path M may vary depending on the position of the deflector 50, and a path of motion followed by the discharge end 52 may be curved, rather than straight.

It is to be understood that the disclosed embodiments are merely exemplary of the invention, which can be embodied in various forms. Specific structural and functional details are not to be interpreted as limiting, but merely as a basis for the claims and as a teaching for one skilled in the art to variously employ the present invention in virtually any appropriately detailed structure. In particular, features presented and described in separate dependent claims may be applied in combination, and any advantageous combination of such claims is herewith disclosed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A deflecting device for deflecting a conveyed sheet, comprising:

a guiding assembly having an inlet for receiving the conveyed sheet from an upstream section of a main conveying path, a primary outlet for discharging the conveyed sheet onto a downstream section of the main conveying path, a secondary outlet for discharging the conveyed sheet onto an initial section of a side conveying path, and a passing area for passing the conveyed sheet from the inlet towards the primary outlet; and a deflector for deflecting the conveyed sheet towards the secondary outlet, movable into a receiving position for receiving a leading edge of the conveyed sheet inside the passing area and movable into a discharge position for discharging the leading edge of the conveyed sheet towards the secondary outlet, wherein the deflector defines a curved trajectory for the conveyed sheet deflected towards the secondary outlet in the discharge position, wherein one side of the curved trajectory faces the primary outlet, wherein a functional portion of the deflector is a portion extending from the receiving position to the discharge position when the deflector is in the discharge position, wherein the functional portion includes an elongated body having a straight deflector surface along substantially an entire length thereof, and wherein the function portion is configured to be inserted into the passing area on the one side of the curved trajectory when the deflector moves into the receiving position, and to be retracted from the passing area on the one side of the curved trajectory when the deflector moves out of the discharge position.

2. The deflecting device according to claim 1, wherein the functional portion is configured to be inserted into the passing area from a side of the passing area opposite a side of the passing area facing the secondary outlet.

3. The deflecting device according to claim 1, wherein the deflector is configured to move through the receiving position at a certain speed before moving into the discharge position.

4. The deflecting device according to claim 1, wherein the functional portion is configured to move at least as fast as the conveyed sheet when the deflector moves from the receiving position into the discharge position.

5. The deflecting device according to claim 1, wherein the deflector surface for receiving the leading edge of the conveyed sheet has an inclined orientation with respect to the upstream section of the main conveying path in the receiving position of the deflector.

6. The deflecting device according to claim 1, wherein the deflector surface for discharging the leading edge of the conveyed sheet extends in line with the initial section of the side conveying path in the discharge position of the deflector.

7. The deflecting device according to claim 1, wherein a speed of motion of the functional portion has a component extending in parallel to the deflector surface for receiving the leading edge of the conveyed sheet when the deflector moves through the receiving position.

8. The deflecting device according to claim 1, wherein a speed of motion of the functional portion has a component extending in parallel to the deflector surface for discharging the leading edge of the conveyed sheet when the deflector moves into the discharge position.

9. The deflecting device according to claim 1, wherein a path of motion of the functional portion is straight or curved.

10. The deflecting device according to claim 1, wherein the functional portion tapers into a tip.

11. The deflecting device according to claim 1, wherein the functional portion is configured to be inserted into the passing area at an acute angle with respect to the main conveying path or at least the upstream section thereof.

12. A sheet handling system comprising the sheet deflecting device according to claim 1 for deflecting the conveyed sheet from the main conveying path to the side conveying path.

13. A printing system comprising a printing path for conveying a stream of individual sheets of an image recording medium past a print engine, and a returning path for returning certain sheets of the image recording medium from an end of the printing path back to a start of the printing path, the printing system comprising the deflecting device according to claim 1 for selectively deflecting the individual sheets of the image recording medium from the main conveying path to the returning path.

14. The deflecting device according to claim 2, wherein the deflector is configured to move through the receiving position at a certain speed before moving into the discharge position.

15. The deflecting device according to claim 2, wherein the functional portion is configured to move at least as fast as the conveyed sheet when the deflector moves from the receiving position into the discharge position.

16. The deflecting device according to claim 3, wherein the functional portion is configured to move at least as fast as the conveyed sheet when the deflector moves from the receiving position into the discharge position.

17. The deflecting device according to claim 2, wherein the deflector surface for receiving the leading edge of a conveyed sheet has an inclined orientation with respect to the upstream section of the main conveying path in the receiving position of the deflector.

18. The deflecting device according to claim 1, wherein the straight deflector surface maintains a substantially constant angle when being moved from the receiving position to the discharge position.

19. The deflecting device according to claim 1, wherein the straight deflector surface is generally parallel to the initial section of the side conveying path when the deflector is in the receiving position.

20. A method for deflecting a conveyed sheet from a main conveying path towards a side conveying path, comprising the steps of:

bringing a deflector into the main conveying path ahead of the conveyed sheet in a first position in which a deflector surface provided on the deflector is arranged for receiving a leading edge of the conveyed sheet and guiding the leading edge towards a discharge end of the deflector in a direction deviating from the direction of conveyance along the main conveying path;

after receiving the leading edge of the conveyed sheet, moving the deflector towards a second position in which the discharge end is positioned closer to an initial section of the side conveying path than in the first position;

discharging the leading edge of the conveyed sheet onto the initial section of the side conveying path, and retracting the deflector from the second position and the main conveying path, wherein a functional portion of the deflector is a portion extending from the first position to the second position when the deflector is in the second position, and wherein the functional portion includes an elongated body having the deflector surface for receiving the leading edge of the conveyed sheet, the deflector surface being straight along substantially an entire length thereof.

* * * * *